US006824126B2

(12) United States Patent
Keller et al.

(10) Patent No.: US 6,824,126 B2
(45) Date of Patent: Nov. 30, 2004

(54) EVAPORATIVE HUMIDIFIER WITH WATER DISTRIBUTION SYSTEM

(75) Inventors: Kevin Eugene Keller, Wichita, KS (US); Luke Edward Kelly, Augusta, KS (US); Glen Wesley Ediger, North Newton, KS (US)

(73) Assignee: Vornado Air Circulation Systems, Inc., Andover, KS (US)

( * ) Notice: Subject to any disclaimer, the term of this patent is extended or adjusted under 35 U.S.C. 154(b) by 63 days.

(21) Appl. No.: 10/389,491

(22) Filed: Mar. 14, 2003

(65) Prior Publication Data

US 2004/0178518 A1 Sep. 16, 2004

(51) Int. Cl.[7] ..... B01F 3/04

(52) U.S. Cl. ..... 261/97; 62/315; 261/106; 261/107; 261/DIG. 3; 261/DIG. 43

(58) Field of Search ..... 261/97, 104, 106, 261/107, 110, DIG. 3, DIG. 43, DIG. 4, DIG. 15, DIG. 41; 62/310, 315; 239/193, 556

(56) References Cited

U.S. PATENT DOCUMENTS

| | | | | | |
|---|---|---|---|---|---|
| 405,064 | A | | 6/1889 | Wood | 239/43 |
| 3,092,096 | A | | 6/1963 | Nett et al. | 126/113 |
| 3,139,462 | A | | 6/1964 | Scott | 261/70 |
| 3,191,915 | A | | 6/1965 | Goettl | 261/97 |
| 3,497,453 | A | | 2/1970 | Yurdin | 210/698 |
| 3,738,621 | A | | 6/1973 | Anderson | 261/29 |
| 4,029,723 | A | | 6/1977 | Morrison et al. | 261/29 |
| 4,158,679 | A | | 6/1979 | Yeagle | 261/106 |
| 4,301,094 | A | | 11/1981 | Baus | 261/29 |
| 4,350,646 | A | | 9/1982 | Baus | 261/29 |
| 4,361,525 | A | * | 11/1982 | Leyland | 261/152 |
| 4,400,185 | A | | 8/1983 | Goettl | 96/359 |
| 4,479,366 | A | * | 10/1984 | Lanier et al. | 62/304 |
| 4,612,778 | A | * | 9/1986 | Medrano | 62/311 |
| 4,657,709 | A | * | 4/1987 | Goettl | 261/3 |
| 5,079,934 | A | | 1/1992 | Vinokurov | 62/304 |
| 5,110,511 | A | | 5/1992 | Hand | 261/104 |
| 5,111,529 | A | | 5/1992 | Glucksman | 392/405 |
| 5,162,088 | A | | 11/1992 | Peng et al. | 261/27 |
| 5,250,232 | A | | 10/1993 | Pepper et al. | 261/24 |
| 5,490,957 | A | | 2/1996 | Lasko et al. | 261/29 |
| 5,682,932 | A | | 11/1997 | Ediger | 141/366 |
| 5,783,117 | A | | 7/1998 | Byassee et al. | 261/29 |
| 5,853,625 | A | * | 12/1998 | Kensok et al. | 261/106 |
| 5,932,148 | A | * | 8/1999 | Hansell et al. | 261/106 |
| 5,971,366 | A | * | 10/1999 | Smith | 261/29 |
| D416,994 | S | | 11/1999 | Kensok et al. | D23/358 |
| 5,975,502 | A | | 11/1999 | Stanek et al. | 261/23.1 |
| 6,189,869 | B1 | | 2/2001 | Stanek et al. | 261/23.1 |
| 6,248,155 | B1 | | 6/2001 | Seaman | 95/211 |
| 6,335,517 | B1 | | 1/2002 | Chauviaux et al. | 219/628 |
| 6,367,277 | B1 | * | 4/2002 | Kinkel | 62/310 |
| 6,367,782 | B1 | * | 4/2002 | Guetersloh | 261/106 |
| 6,588,734 | B2 | * | 7/2003 | Redner et al. | 261/106 |

FOREIGN PATENT DOCUMENTS

| | | | | |
|---|---|---|---|---|
| CA | 635136 | * | 1/1962 | 261/97 |

* cited by examiner

*Primary Examiner*—Richard L. Chiesa
(74) *Attorney, Agent, or Firm*—Stinson Morrison Hecker LLP

(57) ABSTRACT

The invention is generally directed to an evaporative humidifier having a water distribution system capable of quietly maintaining a continuously saturated wicking element through the use of a pump and water distribution troughs that allow water to be continuously flushed onto the tops of the wicking elements such that greater humidification of the air is achieved and the life of the wicking elements are extended.

23 Claims, 7 Drawing Sheets

EVAPORATIVE HUMIDIFIER WITH WATER DISTRIBUTION SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is generally directed to the field of humidifiers, and is more specifically directed to an evaporative humidifier having a free flowing water distribution system that flushes water through the wicking elements in a relatively quiet manner to enhance the reliability and effectiveness of the humidifier over time.

2. Description of Related Art

Dry winter air is harsh and can be hard on people, pets and furniture. Humidifiers have long been recognized as helping to alleviate dry air by adding moisture into the air. Such humidifiers can be built into the air circulation system of a house or building or may be of a more portable nature, specifically for use in individual rooms or offices.

A number of different types of humidifiers are known in the art including steam, ultrasonic, warm-air and evaporative humidifiers. Evaporative humidifiers typically employ a wicking element wherein the bottom edge of the wicking element is in contact with a water reservoir and the wicking element is adapted to draw water up through the remainder of the element via capillary action. Dry air in the environment is drawn into the humidifier and through the wet wicking elements via a fan to thereby humidify the air. This moisturized air is then blown out of the humidifier into the surrounding environment.

There are some drawbacks associated with these type of humidifiers. For example, depending upon the density and height of the wicking element, capillary action in and of itself is not sufficient to wet the entire wick from top to bottom. This means that the wicking element is not uniformly saturated with water (less on the lop than on the bottom), reducing the overall effectiveness of the humidifier. Additionally, during the phase change from liquid water to water vapor in the wicking element, calcium and other minerals contained in the water are deposited in the wicking element. This causes the wicking element to harden, losing its capacity to hold water and thereby further reducing the effectiveness of the humidifier. Evaporative humidifiers also have the disadvantage of propagating stagnant water in the water reservoir which can be a breeding ground for mold and bacteria.

While various evaporative humidifiers have been developed in the art in an effort to overcome these difficulties, there remains a need for a humidifier that is effective and reliable over time in humidifying the air, that is relatively quiet in operation and that is easy to clean and maintain.

BRIEF SUMMARY OF THE INVENTION

The present invention is generally directed to an evaporative humidifier having a free flowing water distribution system comprising a pump that draws water up from a water reservoir through a conduit for release into a trough positioned above the wicking element of the humidifier. The trough includes a plurality of apertures through which the water flows onto the top of the wicking element, and at least one funnel opening at the end of the trough through which any remaining water flows onto the top of the wicking element. The conduit preferably releases the water near the midpoint of the trough onto a water splitter formed via an upwardly extending apex in the bottom surface of the trough. The water splitter diverts the water flow into two streams directed to each end of the trough and a funnel opening is provided at either end of the trough. The trough is therefore designed to allow water to be continuously flushed through the wicking elements such that greater humidification of the air is achieved. This also enhances the life of the wicking elements because the constant flush of water reduces the build-up of calcium and other minerals in the wicking elements.

In a preferred embodiment, the evaporative humidifier is a portable unit having an outer housing configured to define a reservoir for holding water in the bottom of the humidifier. Air inlets are provided on both sides of the humidifier and an air outlet is provided on the top of the humidifier. A compartment at the rear of the humidifier is configured to retain one or more portable water containers such that water is released from the water containers as needed to fill the reservoir. The housing is configured to support a wicking element adjacent each air inlet such that the bottom of each wicking element is in contact with the water in the reservoir. A motorized pump is centrally positioned in the humidifier with the pump head in contact with the reservoir, such that water from the reservoir can be drawn up by the pump through two conduits configured to release the water into corresponding troughs positioned above each wicking element. Each trough is generally U-shaped having an upwardly extending apex formed along its bottom surface at a mid-point of the trough. The conduits release the water onto this apex such that the water flow is split into two streams flowing toward opposite ends of the trough. Oval apertures are provided along the length of the trough configured to allow water to flow therethrough onto the top of the wicking element. A funnel opening at each end of the trough directs any remaining water flow onto the wicking element.

Continuous pumping of water through the water distribution system of the present invention provides for saturation of the wick, thus increasing the efficiency of the humidifier's ability to humidify the air. The constant re-circulation of water additionally slows the natural hardening of the wicking element due to deposits of calcium and other water-borne minerals and extends its life thereby. Furthermore, the trough is virtually self-cleaning as water is continuously flushed down the length of the trough, which prevents the build up of calcium and the need for frequent cleaning. The constant circulation of water also helps to minimize stagnant water, which in turn reduces the potential for mold and bacteria buildup. The present invention achieves all of these advantages, while doing so with a bare minimum of noise to the outside environment.

DETAILED DESCRIPTION OF PREFERRED EMBODIMENT

Figure 1:
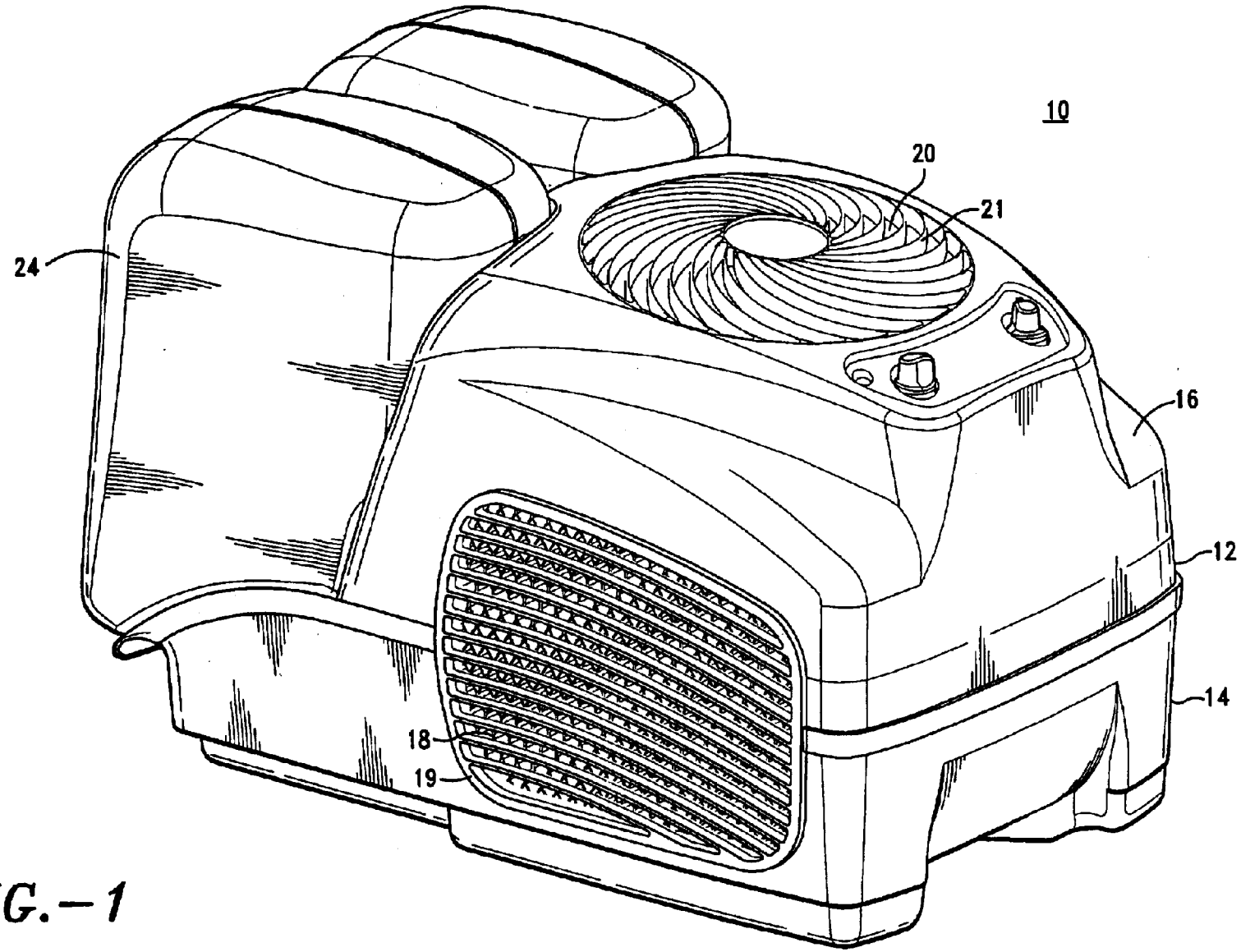
FIG. 1 is a front perspective view of an evaporative humidifier in accordance with a preferred embodiment of the present invention.

With reference to FIG. 1, a portable evaporative humidifier in accordance with a preferred embodiment of the present invention is represented generally by the numeral 10. Humidifier 10 has a housing 12 comprising a base 14 and a removable cover 16. Base 14 and removable cover 16 may be made of any rigid material, is preferably made of a non-corrosive material, and is most preferably formed of injection molded thermoplastic.

Figure 3:
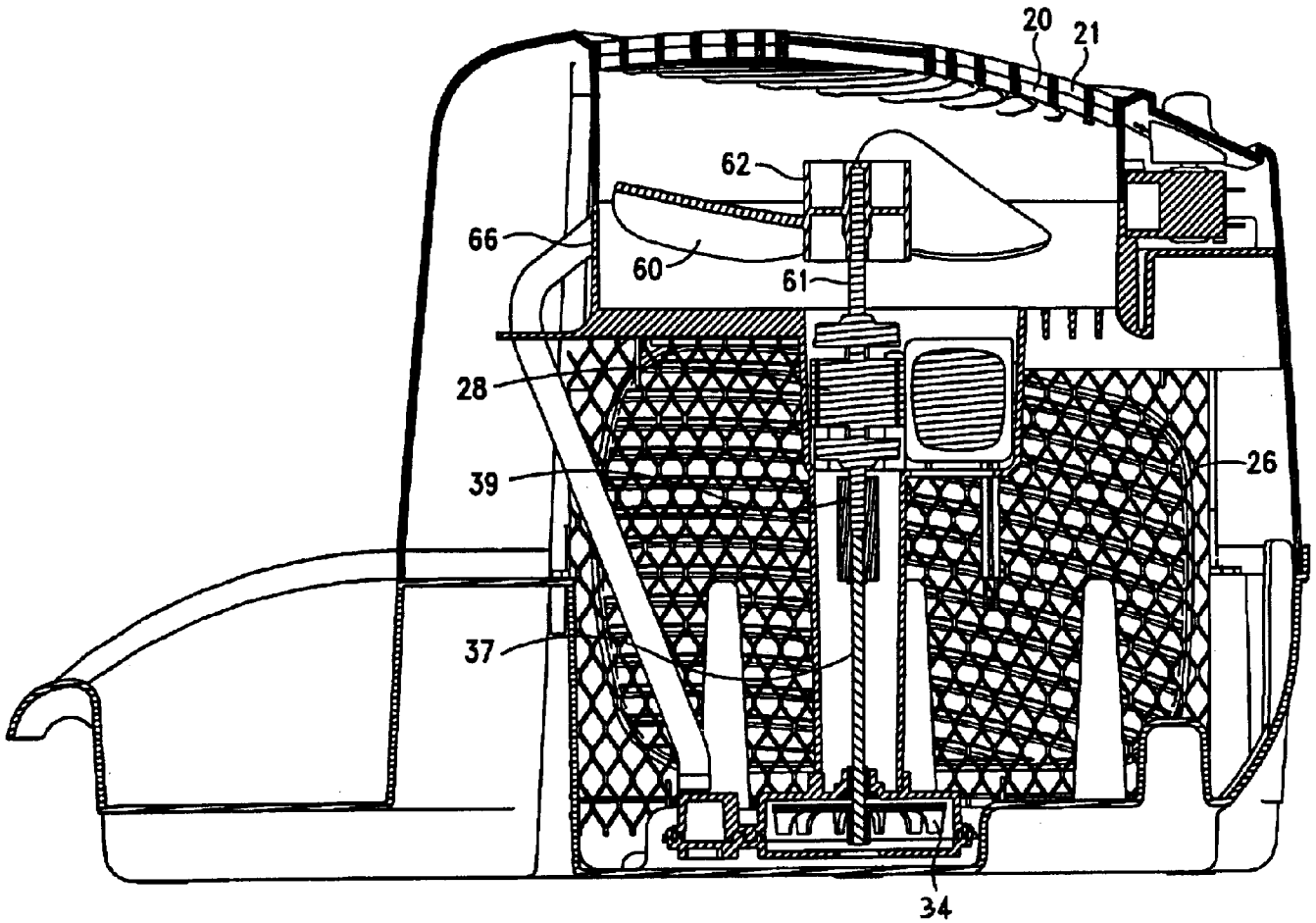
FIG. 3 is a cross section view of the evaporative humidifier of FIG. 1, taken along line 3—3.

Base 14 has a bottom surface, a front wall, left and right side walls, and a rear wall which together define a reservoir 22 for retaining water. Air inlets 18 located on opposite sides of housing 12 are covered by air inlet grills 19 integrally formed with the left and right side walls of base 14. Air inlets 18 are configured to correspond with the dimensions and shape of wicking elements 26 (FIG. 4) such that air flows through a majority of the surface area of wicking elements 26. Air inlet grills 19 contain slats or ribs allowing air to pass through air inlets 18 into the interior of humidifier 10, while preventing user access into the interior. Air outlet 20 is incorporated into the top of top section 16. As shown in FIGS. 3 and 5, base 14 further includes a plurality of support towers extending up from base 14 directly adjacent to and for the purpose of supporting each interior side of wicking elements 26, the preferred embodiment includes six support towers.

Removable cover 16 fits securely onto base 14 by seating the lower edge of the cover onto a shelf formed in the upper lip of base 14. Air outlet 20 located on the top of humidifier 10 is covered by air outlet grill 21 formed integrally with cover 16 to prevent user access to the interior of humidifier 10. Air outlet grill 21 comprises slats or ribs configured to allow air to pass from the interior of humidifier 10 through air outlet 20 to the surrounding environment. The shape and dimension of air inlet grills 19 and air outlet grill 21 preferably provide adequate surface area for air flow, such that the specific shapes thereof may be modified from the shapes depicted in FIG. 1. Cover 16 also provides a control panel through which operational knobs extend for user control. Indicia or labels may be present on the surface of the control panel with instructions for use.

The rear portion of base 14 and the rear wall of cover 16 together define a storage compartment configured to retain two removable water bottles 24 side by side. The water bottles are adapted to release water into reservoir 22 as needed. The upper lip of base 14 is curved along the rear wall to provide a pivot point for receiving water bottles 24 and to support water bottles 24 when positioned in place. While any number of varieties of water bottles are considered suitable for purposes of this invention, it is preferred that the water bottles incorporate a filling funnel and self-operating valve as disclosed in U.S. Pat. No. 5,682,932 incorporated herein by reference in its entirety to maintain the water level at a constant and proper level in reservoir 22. Water bottles 24 preferably include carrying handles located on the interior sides for easy transport. In the preferred embodiment, water bottles 24 are rectilinear in shape, configured to hold two gallons of water each, and are formed as a unitary blow-molded plastic bottle. In this manner, the bottles are relatively lightweight and easy for the user to handle while providing a significant amount of water supply for the humidifier. Of course, it should be understood that other shapes, sizes and constructions of water bottles are suitable for purposes of this invention, and that the humidifier may alternatively be configured to retain only one or more than two water bottles. Furthermore, it is anticipated that the humidifier need not utilize portable water bottles, but may utilize a different source of water.

Figure 2:
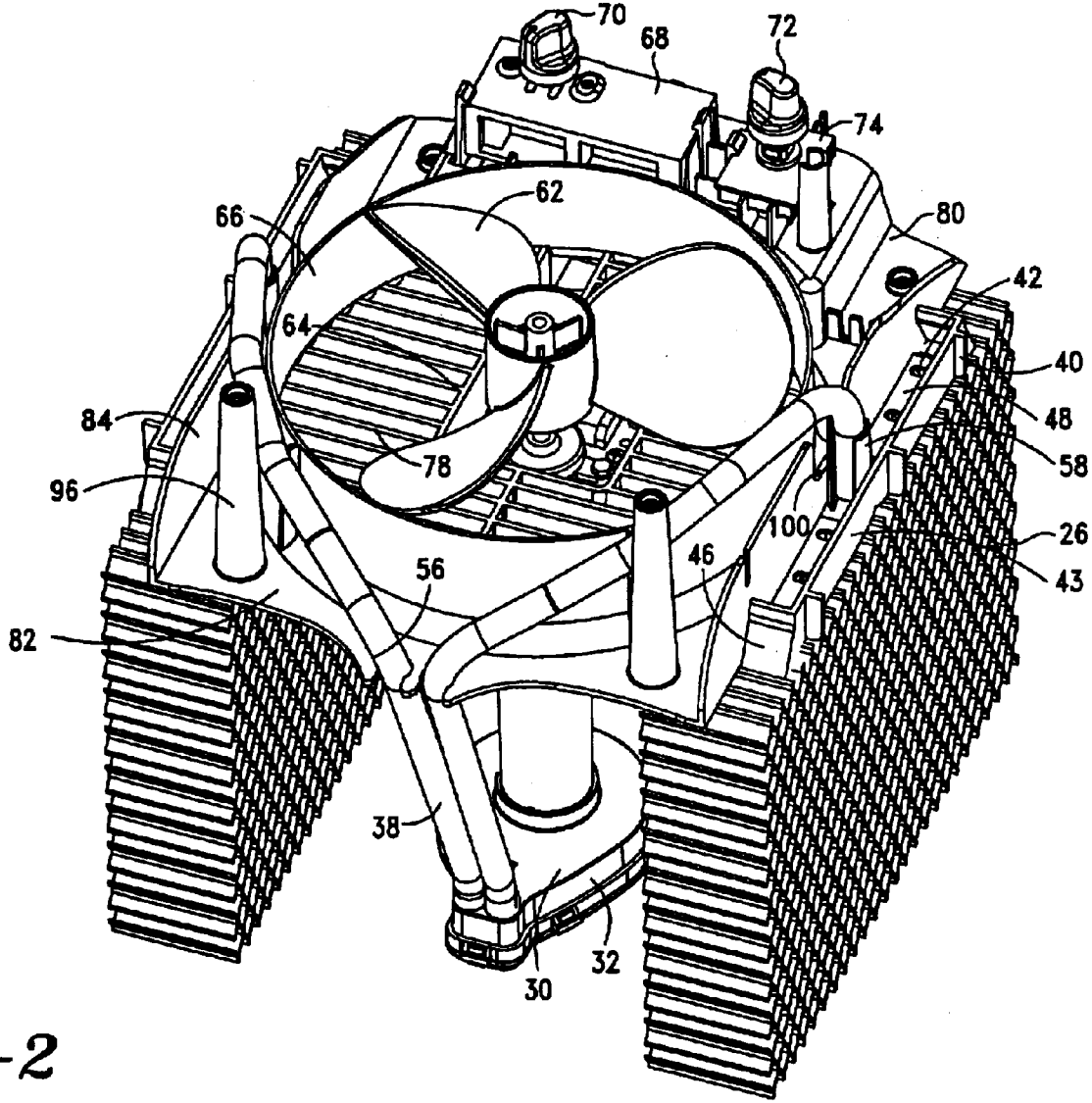
FIG. 2 is a rear perspective view of the internal components of the evaporative humidifier, with the housing and water bottles not shown.

As shown in the internal views of FIGS. 2 and 5, humidifier 10 is configured to retain two wicking elements 26 in an upright position such that the bottom edge of each wicking element 26 is submerged in reservoir 22 and the outer side surface of each wicking element 26 extends upwardly adjacent and immediately interior to air inlets 18. Wicking elements 26 may be formed of any material and constructed in any manner which enables water to be distributed throughout a relatively large surface area of the element so as to facilitate the evaporation of water as forced air is drawn through the element. A variety of suitable wicking elements are known in the art and may comprise paper wicks, as well as cardboard, plastic or metal evaporator panels. In the preferred embodiment, wicking elements 26 comprise cellulose sheets cut into an expanded diamond pattern having layers bonded together with a melted plastic sheet, such as those manufactured by Columbus Industries in Columbus, Ohio.

While wicking elements 26 are generally rectangular in shape in the embodiment shown in the drawings, it is anticipated that various other configurations are suitable for purposes of this invention provided that a sufficient amount of outer surface area is provided to enable humidification of the air drawn through air inlets 18. Preferably, the edges of wicking elements 26 extend past the edges of air inlets 18.

As best shown in FIG. 5, in the preferred embodiment, reservoir 22 comprises a series of reservoirs 22*a*, 22*b*, 22*c* connected by channels to permit free fluid flow communication. Water is released into a water bottle reservoir (not shown) by water bottles 24 and then flows freely via channels (not shown) integrally formed in base 14 to wicking element reservoirs 22*a*, 22*b* extending along the bottom of each wicking element 26 and pump reservoir 22*c* extending below pump head 30. Reservoir 22 is reasonably shallow and need only hold a sufficient amount of water for absorption by wicking elements 26 and distribution via pump 28.

A motorized pump 28 and fan assembly 60 are supported by support frame 80 (as hereafter described) in the center of housing 12. Pump 28 comprises pump head 30 which is seated in pump reservoir 22*c* such that water inlets located in pump head 30 are submerged in water when humidifier 10 is in use. Pump head 30 is constructed using conventional centrifugal pumping principles and is preferably made of injection molded thermoplastic. Pump head 30 comprises pump housing 32 having a top and a bottom snapped together along a flange formed along the outer edge of the bottom to define an internal pump chamber for impeller 34 to act within. Impeller 34 is preferably made of injection molded thermoplastic and induces the centrifugal forces on the water to draw water though water inlets and up through conduits 38. Pump 28 of the present invention is a standard pump commonly used in portable humidifiers.

Impeller 34 is driven by motor 36, wherein motor shaft 35 extends downwardly from the bottom of motor 36 and is coupled with connecting rod 37 via coupler 39. Coupler 39 is preferably formed of rubber. The bottom end of connecting rod 37 is secured within the center of impeller 34 and is preferably formed of stainless steel.

Motor 36 is preferably a standard C-frame motor that is readily commercially available as a purchased part. Fan assembly 60 comprises an axial fan blade 62 driven by rod 61 extending upwardly from the top of motor 36. Fan assembly 60 is preferably made of injection molded thermoplastic.

Looking to FIG. 2, support frame 80 provides support for motorized pump 28, fan blade assembly 62, troughs 40 and operational controls. Support frame 80 comprises a planar horizontal base 82 having divider walls 84 extending vertically upward from the outer side edges of base 82. A central upwardly extending collar 66 defines a fan chamber in which the fan blade assembly 62 operates. Grills 78 extend horizontally inward from collar 66 along the bottom of the fan chamber toward an inner perimeter edge to define a blade guard 64 and a central shaft opening 76 through which rod 61 extends from motor 36.

Looking to FIG. 5, receptacle walls 86 extend downwardly from the inner perimeter edge to a continuous flange 88 that extends inwardly from the bottom edge of receptacle walls 86. Receptacle walls 86 and bottom flange 88 together define receptacle 90 to hold motor 36, wherein the bottom of motor 36 rests upon a shelf 92 formed by continuous flange 88. A cover extends downwardly from the inner edge of continuous flange 88 and fits snugly within upwardly extending collar on the top of pump housing 32 to cover shaft 35 and connecting rod 37.

Figure 4:
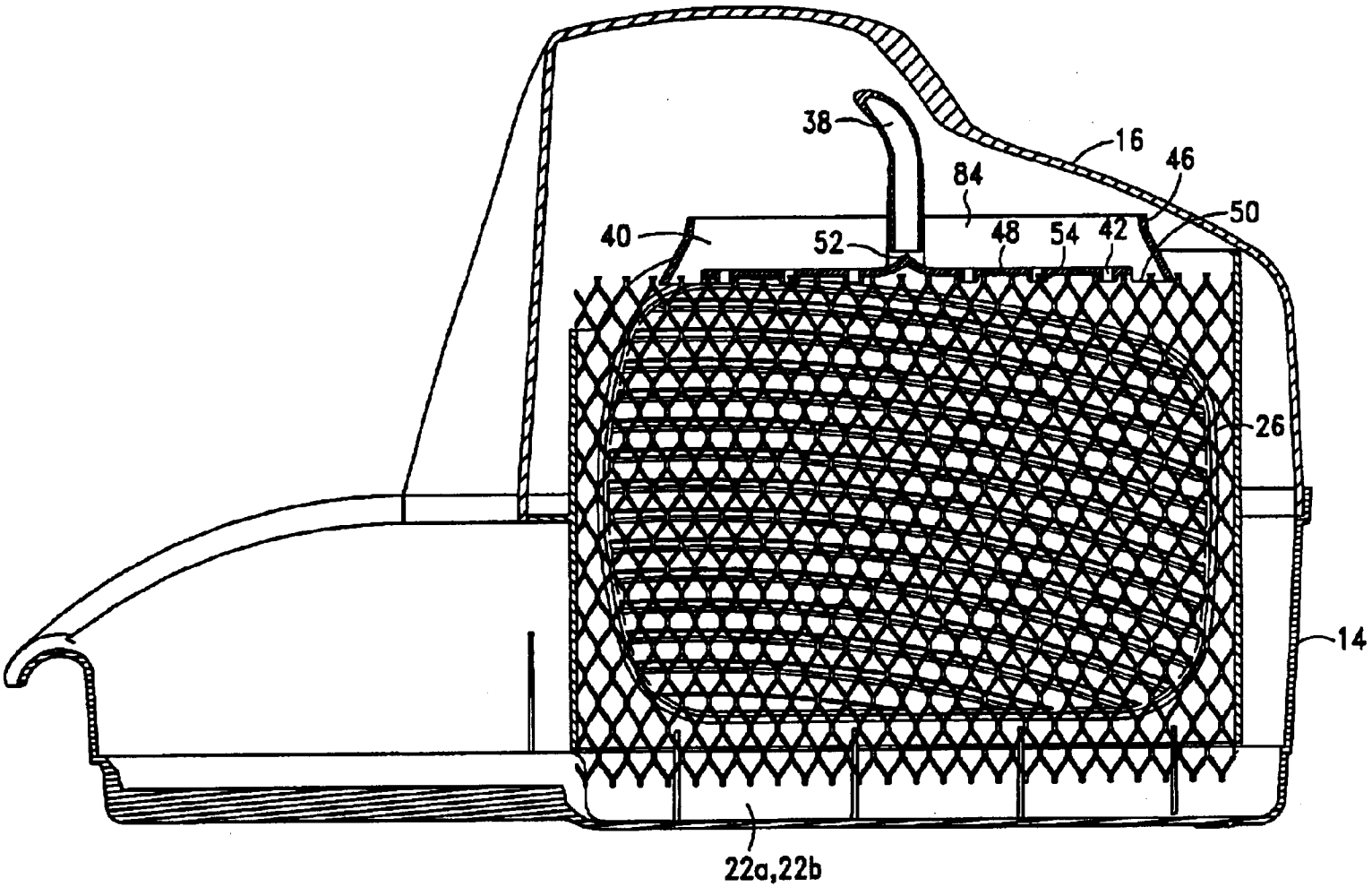
FIG. 4 is a cross section view of the evaporative humidifier of FIG. 1, taken along line 4—4.
Figure 5:
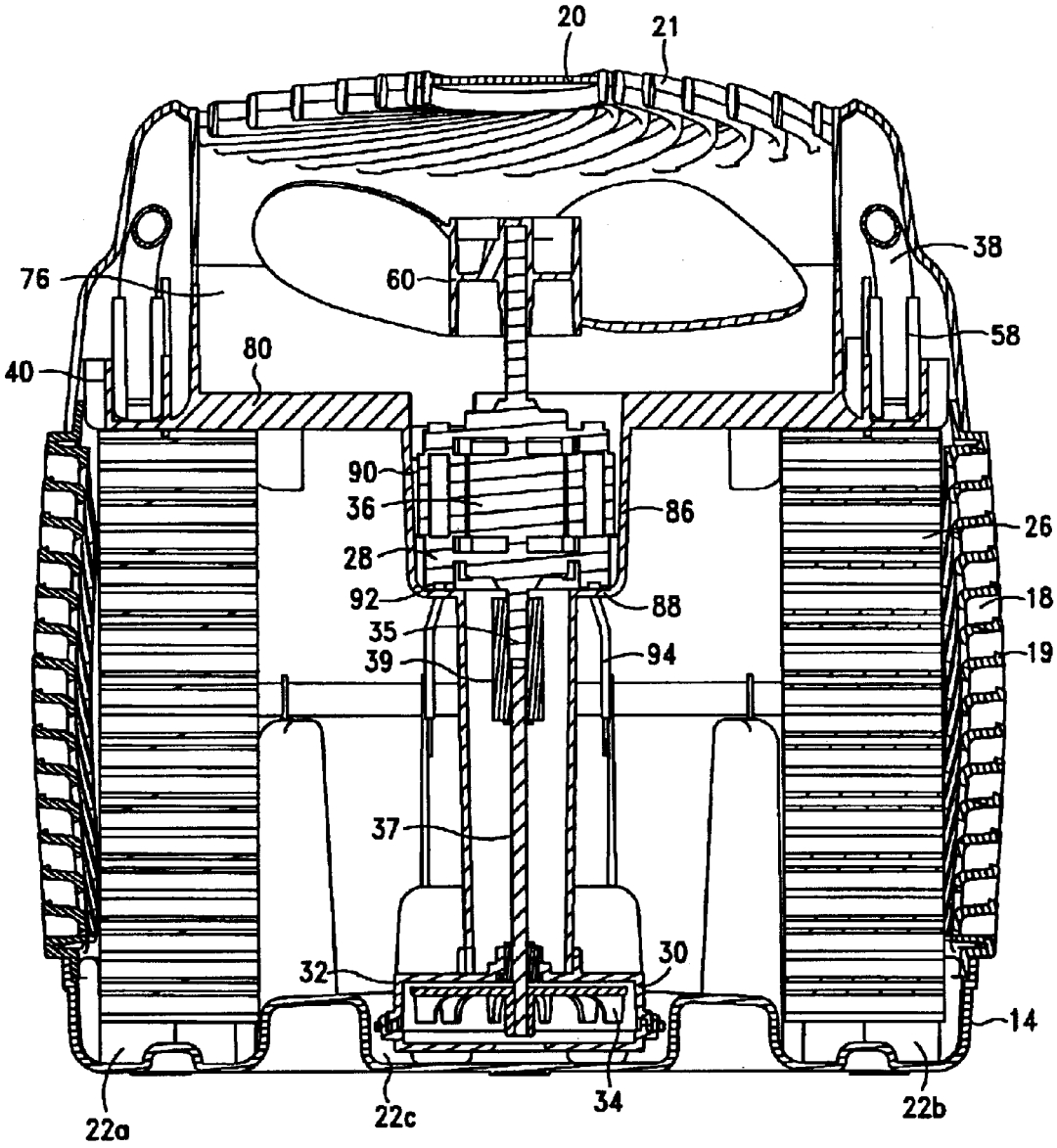
FIG. 5 is a cross section view of the evaporative humidifier of FIG. 1, taken along line 5—5.

As best shown in FIGS. 2 and 4, water distribution troughs 40 are configured to extend immediately above wicking elements 26. While it is desirable for trough 40 to extend along a majority of the length of wicking elements 26, it is also preferred that troughs 40 are shorter in overall length than wicking elements 26 so as to assure that any water flow from troughs 40 is distributed onto wicking elements 26. Troughs 40 are generally U-shaped to assist in the flow of water and have a relatively flat bottom surface extending outwardly from the bottom of divider walls 84 to an outer edge. Of course, it should be understood that other trough configurations are considered suitable. Outer side wall 43 extends upwardly along the outer edge of trough bottom surface 48 and extends beyond the front and rear ends of trough bottom surface 48. Trough end walls 46 extend inwardly from the front and rear ends of outer side wall 43 respectively to divider wall 84. Funnel openings 50 are formed as gaps between the ends of trough bottom surface 48 and trough end walls 46. Trough end walls 46 are angled outwardly in a downward sloping direction so as to more easily guide the water flow downward onto the top of wicking element 26 without excessive noise and splashing. Trough end walls 46 extend vertically downward to a position in a plane that is lower that the plane of trough bottom surface 48. Troughs 40 are preferably made of injection molded thermoplastic.

A plurality of apertures 42 are provided along the length of trough bottom surface 48 to allow water flow through apertures 42 onto wicking element 26. The preferred embodiment shown in the drawings contains six apertures 42 per trough 40, although this number may be increased or decreased as desired, as long as the number of apertures is sufficient to allow adequate dispersion of water onto wicking elements 26. Apertures 42 are preferably oval shaped to maximize water flow, but it should be understood that a variety of other shapes could be employed, such as round, square or rectangular.

Figure 6:
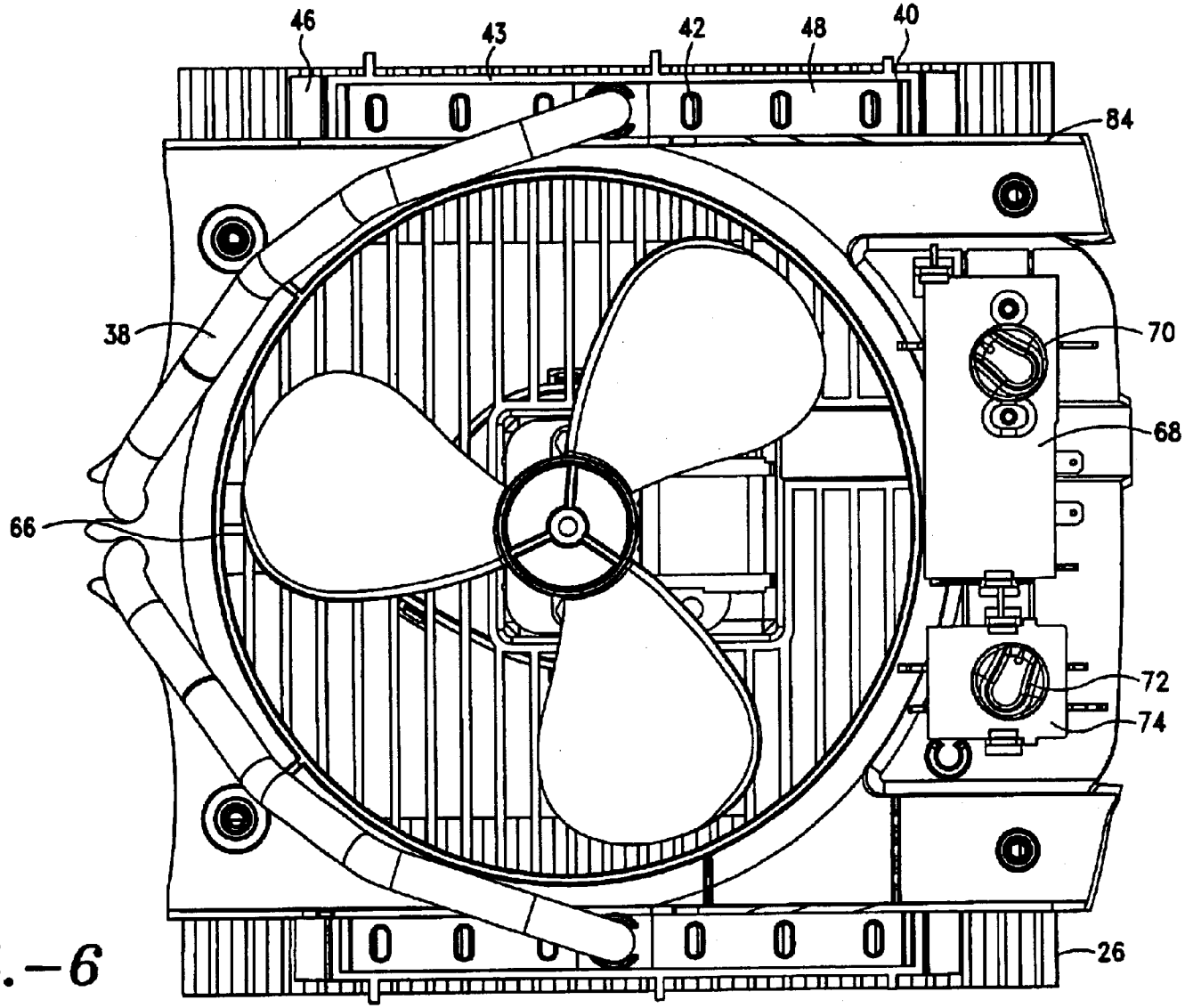
FIG. 6 is a top view of the internal components of the evaporative humidifier as shown in FIG. 2.

As shown in FIG. 4, water splitter 52 is formed in trough bottom surface 48 and consists of two sloped portions forming an apex located near the midpoint of the length of trough 40. As depicted in FIG. 6, lips 54 extends downwardly from the underside of trough bottom surface 48 surrounding the perimeter of each aperture bottom to promote the flow of water down onto wicking element 26 and inhibit water flowing along the underside of trough bottom surface 48.

Figure 7:
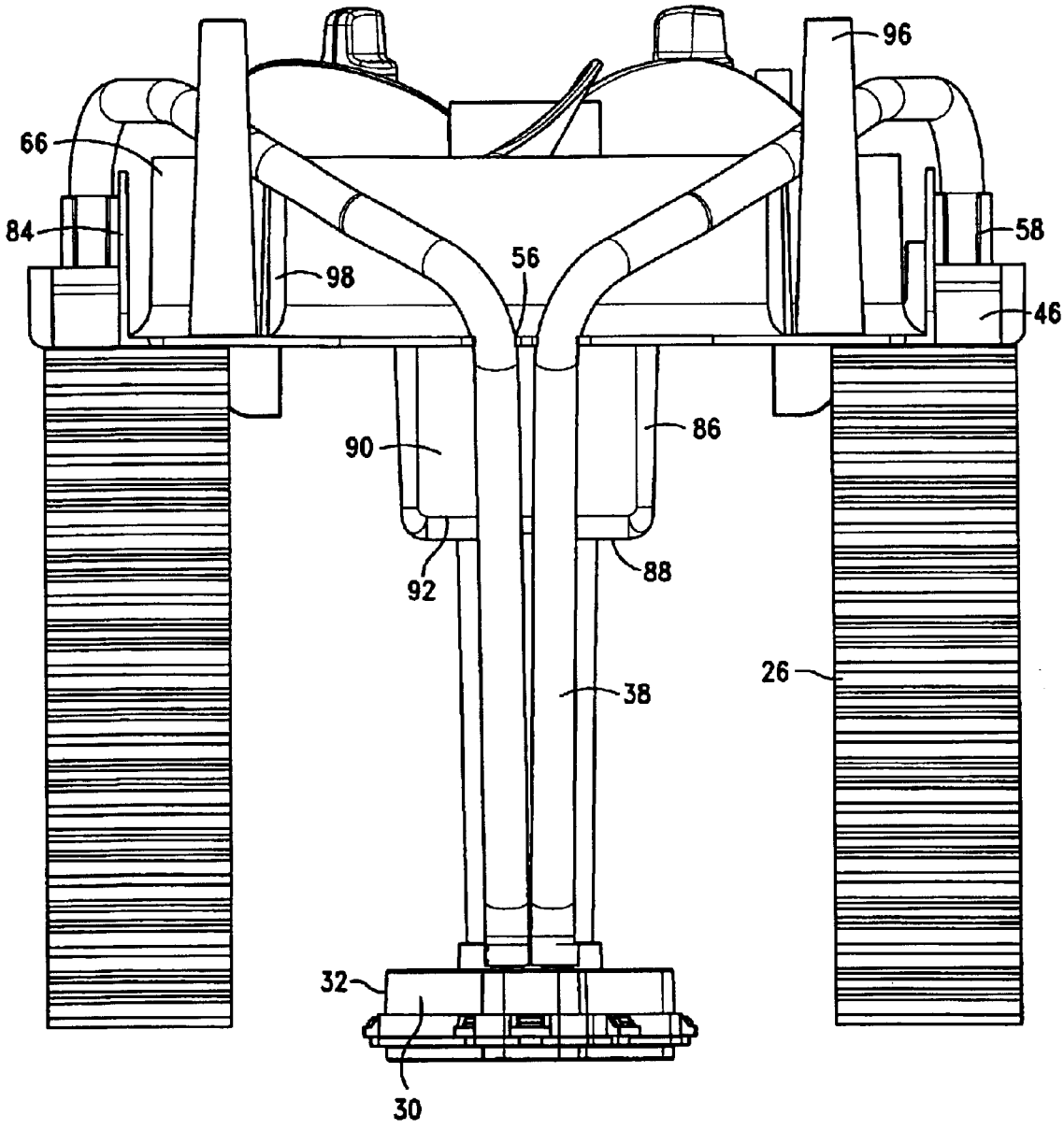
FIG. 7 is a rear view of the internal components of the evaporative humidifier as shown in FIG. 2.

As shown in FIG. 7, two conduits 38, preferably vinyl tubes, are secured to pump 28 such that water drawn from pump reservoir 22*c* is pumped through conduits 38. Conduits 38 are routed upward through tube supports 56 in support frame 80 and around each side of collar 66 respectively. The conduit ends are secured within tang tube supports 58 which position and support the ends directly above water splitter 52. In this manner, water is discharged from conduits 38 onto water splitter 52 such that the water flow is diverted into two streams which flow along the length of trough 40 toward each end.

Humidifier 10 includes standard controls which, in the preferred embodiment, are secured to the top of support frame 80 at the front of humidifier 10. Portable evaporative humidifier 10 includes a power light (not shown) to indicate when the power to the unit is on. The power light is a standard part that is commercially available. Portable evaporative humidifier also includes a power cord (not shown) that connects the unit to an external electrical power source. The power cord is a standard part that is commercially available. As shown in FIGS. 2 and 6, rotary switch 72 is secured to support frame 80 and controls the speed of the fan assembly unit 60 as is known in the art. Rotary switch 72 is controlled by switch knob 74 that extends upwardly through an opening in cover 16 for user access. The operation and structure of rotary switches for humidifiers and other appliances are well known in the art. While any number of commercially available switches are considered suitable for purposes of this invention, preferred rotary switches are manufactured by Tower Manufacturing.

Humidistat 68 is also secured to support frame 80 and enables the unit to turn on and off depending on the ambient relative humidity. Humidistat 68 is controlled by humidistat knob 70 which extends upwardly through an opening in cover 16 for user access. The operation and structure of humidistats for humidifiers and other appliances are well known in the art. While any number of commercially available humidistats are considered suitable for purposes of this invention, a preferred humidistat is manufactured by Tecxwell.

Support frame 80 includes two upstanding legs 96 configured to provide support for cover 16 and to retain conduits 38 in position around collar 66. In addition, collar 66 may include outwardly extending flanges 98 with a central cutout into which conduits 38 may be positioned to further secure conduits 38 in place. Lastly, a notch 100 may be provided in each divider wall 84 adjacent the tang tube supports 58 through which conduits 38 may be routed. It is noteworthy that in the preferred embodiment shown in the drawings the components of the support frame 80 and trough 40 are integrally formed as a single unit by injection molding. Of course, it should be understood that various components of the support frame and trough may be formed separately and secured together using various means including via screws, bolts, glue, ultrasonic welding and other fastening means known in the art.

Operation

The present invention humidifies dry hard air by drawing air through two large wicking elements 26 designed for maximum life and efficiency. The air is drawn through air inlets 18, and through wicking elements 26 via a very quiet deep-pitched impeller 34 and is directed through air outlet grill 20 into the surrounding environment. This quiet airflow helps create whole-room circulation by spreading the humidified air throughout multiple rooms while at the same time destratifying the air. This air circulation also brings the warm air down from the ceiling and creates a constant temperature throughout the living space.

To utilize the evaporative humidifier of the present invention, water is first transported from a sink to the evaporative humidifier 10 via water bottles 24. Water from water bottles 24 is contained in reservoir 22 and maintained at a constant level, due to the construction of water bottles 24. As water is evaporated, additional water is automatically dispensed into reservoir 22 from water bottles 24.

Pump 28 draws up water from pump reservoir 22*c* through conduits 38 for dispersion into water distribution troughs 40. Water is drawn into pump 28 via pump inlets located in the bottom of pump head 30. Water is dispensed into troughs 40 from conduits 38 onto water splitter 52 located in the center of each trough 40 which splits the water flow toward each end of trough 40. The sloped transition of water splitter 52 causes a change in directional flow of water from vertical to horizontal, without introducing turbulence thereby eliminating excessive water noise. Water then travels down troughs 40.

Water is dispersed onto wicking elements 26 through apertures 42 located throughout the length of trough bottom surface 48. Apertures 42 are positioned perpendicular to the water flow. Apertures 42 also have a slight lip 54 on the underside of the trough surrounding the aperture to direct water flow in a uniform manner downward through wicking elements 26 rather than allowing drops to travel horizontally down trough bottom surface 48. Apertures 42 thereby divert some of the water flowing through troughs 40 downward and onto the top of wicking elements 26.

Any remaining water that does not flow down through apertures 42 is directed toward each end of water distribution trough 40 and is dispersed onto wicking elements 26 through funnel opening 50. To aid in the flow of water, trough end walls 46 are angled outwardly in a downward sloping direction to better guide the water flow downward onto the top of wicking element 26. Further aiding water flow is the difference in length between troughs 40 and wicking elements 26 wherein troughs 40 are preferably shorter in length than wicking elements 26 such that excess water is directed through funnel openings 50 onto wicking elements 26 rather than directly into reservoir 22.

Fan assembly 60 pulls dry air through air inlets 18 and through wet wicking elements 26, thereby humidifying the air. The humidified air is then pushed out into the environment through air outlet 20. Fan assembly 60 has an axial blade 62 that provides air movement through the unit. Fan assembly 60 operates according to well-known principles of operation. Housing 12 also contains electric motor 36 and pump 28 for use in connection with the water distribution system of the unit described above. Motor 36 and pump 28 operate according to well-known principles of operation. The motor speed is adjusted by power switch 72.

Water is continuously pumped onto wicking elements 26 through trough 40, apertures 42, and funnel opening 50 which aids in extending wick life, enhancing humidification, and minimizing stagnant water. Even though wicking elements 26 are designed for extended life, they are easily and safely disposed of and also act as a filter to capture calcium and other water-borne minerals for easy clean-up. Because water continuously drips down onto wicking elements 26, wicking elements 26 remain saturated at all times. This results in increased humidification and extended wicking element life.

Quiet operation of the preferred embodiment is maintained by having smooth transitions in water flow with all water being directed through wicking elements 26, thereby minimizing all dripping water sounds on any speed. The flow-through design allows for water to be dispensed over the full length of troughs 40 even at low speeds. On higher speeds, the additional water is still directed out of troughs 40, through funnel openings 50, onto wicking elements 26 and returned to reservoir 22, thereby minimizing excess noise. Water splitter 52 further aids in the quiet operation of humidifier 10 by gently transforming the horizontal water flow coming out of conduits 38 to a vertical water flow down troughs 40.

The preferred embodiment is in effect self-cleaning as apertures 42 and funnel openings 50 inhibit retention of water in troughs 40. The continuous flow of water from water bottles 24 to reservoir 22, to pump 28, to conduits 38, and through trough 40 inhibits buildup of calcium or other mineral deposits within humidifier 10. The rush of flowing water creates a flushing out effect of troughs 40 and wicking elements 26, thereby reducing or even eliminating the need for clean-up.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and sub-combinations are of utility and may be employed without reference to other features and sub-combinations. This is contemplated by and is within the scope of the claims.

What is claimed and desired to be secured by Letters Patent is as follows:

1. An evaporative humidifier for providing moisturized air to the surrounding environment comprising:

a housing defining an interior;

an air inlet through which air may enter the interior;

an air outlet through which air may exit the interior;

a reservoir adapted to retain a liquid supply at the bottom of said interior, wherein said interior is adapted to retain a wicking element in said interior, such that a bottom portion of said wicking element is in fluid communication with said reservoir and an outer surface of said wicking element is positioned adjacent said air inlet;

a fan for forcing air flow into said interior via said air inlet, through said wicking element, and out said interior compartment via said air outlet;

a trough positioned to be disposed above said wicking element, said trough comprising a bottom surface configured to extend at least a portion of a length of said wicking element and at least one end wall separated from said bottom surface by an opening, said bottom surface comprising a plurality of apertures for directing liquid through said trough onto said wicking element and said end wall being configured to direct liquid through said opening; and a pump adapted to pump liquid from said reservoir to said trough.

2. The evaporative humidifier of claim 1, wherein said end wall extends downward at a sloped angle outwardly from said bottom surface.

3. The evaporative humidifier of claim 1, wherein said end wall extends downward to a location that is lower than a plane of said bottom surface.

4. The evaporative humidifier of claim 1, wherein said trough has opposing ends and each end has an end wall separated from said bottom surface by an opening.

5. The evaporative humidifier of claim 1, wherein a length of said trough is less than a length of said wicking element.

6. The evaporative humidifier of claim 4, wherein said bottom surface comprises a splitter configured to divert the flow of fluid toward opposing ends of said trough.

7. The evaporative humidifier of claim 1, wherein said trough further includes at least one lip located on an underside of said trough surrounding one of said apertures.

8. The evaporative humidifier of claim 1, wherein said plurality of apertures are oval in shape.

9. The evaporative humidifier of claim 1, wherein said trough additionally comprises side walls extending upwardly from said bottom surface.

10. The evaporative humidifier of claim 9, wherein said bottom surface of the trough is generally planar.

11. The evaporative humidifier of claim 9, wherein said sidewalls are curved adjacent said bottom surface to provide a U-shaped trough.

12. The evaporative humidifier of claim 1, wherein said humidifier additionally comprises conduit extending from said pump and positioned to release liquid onto said splitter.

13. The evaporative humidifier of claim 1, wherein said humidifier additionally comprises a receptacle for storing portable liquid supply containers in fluid communication with said reservoir.

14. An evaporative humidifier for providing moisturized air to the surrounding environment comprising:

a housing defining an interior of a humidifier;

two air inlets on opposite sides of said housing;

an air outlet on a top of said housing;

a reservoir adapted to retain a liquid supply, wherein said interior is adapted to retain two wicking elements on opposite sides of said housing such that a bottom portion of each element is in fluid communication with said reservoir and a side of each element is adjacent a respective air inlet;

a fan for forcing air flow into said interior through said air inlets, through said wicking elements, and out through said air outlet;

two troughs positioned to be disposed above each of said wicking elements, each said trough comprising a bottom surface configured to extend at least a portion of a length of said wicking element and two end walls, wherein said bottom surface comprises a plurality of apertures for directing liquid through said trough onto said wicking element and wherein each said end wall is separated from a respective end of said bottom surface by an opening and is configured to direct liquid through said opening onto said wicking element; and a pump adapted to pump liquid from said reservoir through two conduits to a respective trough.

15. The evaporative humidifier of claim 14, wherein each said end wall extends downward at a sloped angle outwardly from said bottom surface.

16. The evaporative humidifier of claim 14, wherein each said end wall extends downward to a location that is lower than a plane of said bottom surface.

17. The evaporative humidifier of claim 14, wherein a length of each said trough is less than a length of said wicking element.

18. The evaporative humidifier of claim 14, wherein said bottom surface comprises a splitter adjacent a midpoint of said trough, said splitter configured to divert the flow of fluid from said conduit into two fluid streams directed toward opposite ends of said trough.

19. The evaporative humidifier of claim 14, wherein each said trough further includes a plurality of lips located on an underside of said trough surrounding each one of said apertures.

20. The evaporative humidifier of claim 14, wherein each said trough additionally comprises side walls extending upwardly from said bottom surface.

21. The evaporative humidifier of claim 14, wherein said conduit is positioned to release liquid onto said splitter.

22. The evaporative humidifier of claim 14, wherein said humidifier additionally comprises a receptacle adapted to store two portable liquid supply containers in fluid communication with said reservoir.

23. An evaporative humidifier for providing moisturized air to the surrounding environment comprising:

a reservoir for retaining a liquid supply, wherein the humidifier is adapted to retain a wicking element, such that a bottom portion of said wicking element is in fluid communication with said reservoir; and a trough positioned to be disposed above said wicking element, said trough comprising a bottom surface configured to extend at least a portion of a length of said wicking element and at least one end wall separated from said bottom surface by an opening, said bottom surface comprising a plurality of apertures for directing liquid through said trough onto said wicking element and said end wall being configured to direct liquid through said opening.

* * * * *